US006591828B1

(12) United States Patent
Schneider

(10) Patent No.: US 6,591,828 B1
(45) Date of Patent: Jul. 15, 2003

(54) COLLAPSIBLE CAMP OVEN, STOVE TOP, GRILL

(75) Inventor: Donna Gail Schneider, 5880 Derby Rock Loop, Manitou Springs, CO (US) 80829

(73) Assignee: Donna Gail Schneider, Manitou Springs, CO (US)

( * ) Notice: Subject to any disclaimer, the term of this patent is extended or adjusted under 35 U.S.C. 154(b) by 0 days.

(21) Appl. No.: 10/293,120

(22) Filed: Nov. 13, 2002

(51) Int. Cl.[7] ..... F24C 15/08
(52) U.S. Cl. ..... 126/9 R; 126/9 B; 126/275 R
(58) Field of Search ..... 126/9 R, 9 B, 126/65, 59, 275 R

(56) References Cited

U.S. PATENT DOCUMENTS

| | | | | |
|---|---|---|---|---|
| 1,411,596 A | | 4/1922 | Tallman | |
| 3,308,807 A | | 3/1967 | Little et al. | |
| 4,069,806 A | | 1/1978 | Landry | |
| 4,508,096 A | * | 4/1985 | Slattery | 126/9 R |
| 5,119,799 A | | 6/1992 | Cowan | |
| 5,713,344 A | * | 2/1998 | Gilbert | 126/29 |
| 6,035,768 A | * | 3/2000 | Kaufman | 99/449 |
| 6,073,542 A | * | 6/2000 | Perez | 99/340 |

OTHER PUBLICATIONS

Fox Hill Corp., Single Oven, Website, Oct. 23, 2002, US.
Fox Hill Corp., Double Oven, Website, Oct. 23, 2002, US.

* cited by examiner

*Primary Examiner*—Alfred Basichas

(57) ABSTRACT

A collapsible, self-contained cooking unit that converts into an oven, stove top, or grill while camping or in home emergencies. The unit quickly assembles without the use of hinges, bolts, or screws for support, folds flat for storage, and uses its own base and cover to form a compact carrying case. The unit includes a flanged grill and two metal containers to use when a solid cooking surface is needed for baking or frying. Both containers fit inside the unit while in the storage configuration, eliminating the need for additional cookware. The grill, when inserted selectively between the front and rear panels of the unit and placed horizontally across the interior of the main frame, allows different levels of cooking for all types of food. The inserting of the grill in this manner also creates a sturdy framework and protective housing from flying embers and other heat related hazards.

3 Claims, 3 Drawing Sheets

COLLAPSIBLE CAMP OVEN, STOVE TOP, GRILL

CROSS-REFERENCE TO RELATED APPLICATIONS

Not Applicable.

FIELDS OF SEARCH

126/9 R, 126/275

STATEMENT REGARDING FEDERALLY SPONSORED RESEARCH OR DEVELOPMENT

Not Applicable.

REFERENCE TO SEQUENCE LISTING, A TABLE OR A COMPUTER PROGRAM LISTING COMPACT DISK APPENDIX

Not Applicable.

BACKGROUND OF THE INVENTION

This invention furnishes the user with a self-contained, collapsible, compact cooking unit with cookware that offers three cooking options of oven, stove top, and grill for use in the outdoors or in home emergencies, and fits into a backpack.

In the past, camping cooking options, for the most part, have been limited to an oven, or a grill or stove top cooking, or a combination of the two aforementioned options, but not all three.

While searching the different cooking options available in portable camp units, several compact, collapsible units found were interesting and may be appealing to the occasional camper, but many of the units found in the search collapsed for storage with the use of hinges that are susceptible to breakage or the unit's framework used metal re-enforcement plates that attached to the corners with bolts or screws that might get lost during use. Although compact, many of these units do not offer all three cooking options, did not provide cookware that fits inside the unit when in a storage configuration, and would not fit inside a backpack for increased portability.

Two portable box units found in the search did offer the user baking options by placing the units frame over a direct heat source such as an electric, gas, or liquid fuel stove but neither of these units offered the user a grilling option or cookware from within the unit itself.

When camping in the outdoors, weather can change drastically and often flames are extinguished under windy conditions or when precipitation exists. This unit's grill, when inserted between the front and rear panels of the frame not only provides the cooking surface and different levels of cooking, but also creates a sturdy framework. The assembled unit provides a protective housing for the heat source, which reduces the chance of flame loss, flying charcoal embers, or heat related hazards.

Using a variety of metal materials, home made prototypes were constructed in the same size as the claimed invention and a second prototype in a much smaller size. Without deviating from the scope and exact design of the present invention both prototypes being of different sizes and materials met expectations in providing all three cooking options of baking, grilling and stove top cooking, providing sufficient cookware for cooking in the outdoors, and both units easily fit inside a backpack.

BRIEF SUMMARY OF THE INVENTION

This tri-cooking unit is easy to assemble and converts into an oven, stove top or grill using a variety of fuel sources and by placing the grill at the desired cooking height and across the interior width of the frame, and which said grill sits on the top edge of the selected front and rear panels, providing the cooking surface, and regulating the amount of heat that comes in contact with the food.

When used as an oven, the unit can use charcoal for slow even cooking and the variety of front and rear panel heights can be combined to create several different levels of cooking heights reducing the chance of burned or scorched food. A sheet of aluminum foil can be placed on base bottom prior to adding charcoal for easy clean up. Air circulation and venting occurs naturally at panel joints.

The cooking surfaces, which are part of the unit, comprise a grill and optional metal containers with 90 degree upwardly bent edges around perimeter and metal containers which sit directly on top of and are supported by the grill. These metal containers are used as cookware for baking or frying foods that do or do not require containment and store inside the unit's storage or carrying case with all other members, eliminating the need for additional cooking containers.

The goal when designing this invention was to provide the user with a unit that offers different levels of cooking as well as a variety of cooking options to include baking, frying and grilling in the outdoors or in home emergencies, and uses materials from within itself for assembly, cooking, and storage to create a truly collapsible, compact unit and carrying case that fits into a backpack and is easily transported.

DETAILED DESCRIPTION OF THE INVENTION

To open unit from storage position, locate the finger pull indentation located on one end of cover (5A) and one end of base (1A) and pull outward in opposite directions to open case and expose contents.

Figure 1:
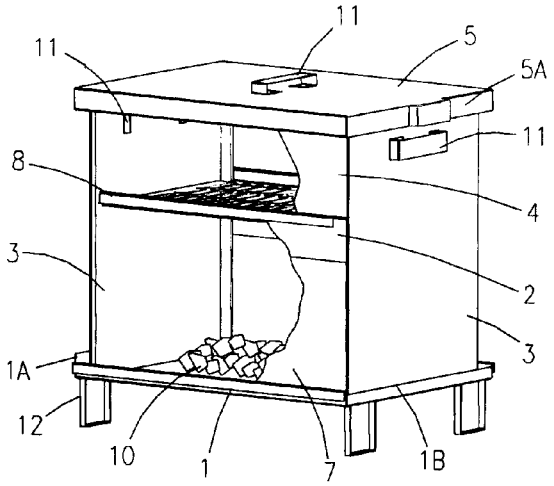
FIG. 1. View of the oven using charcoal fuel, with grill inserted at a high cooking level and fully enclosed.
Figure 4:
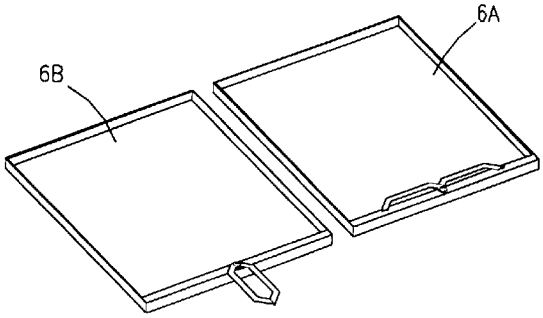
FIG. 4. View of two metal containers with handles used as cookware. One container shows handle in the use position and the second container shows handle in the storage position.
Figure 5:
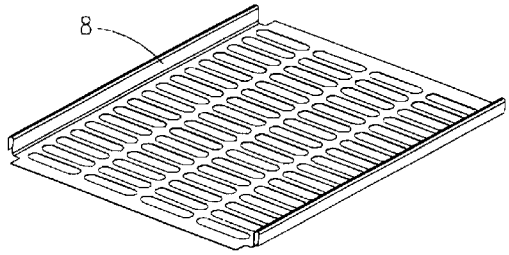
FIG. 5. View of grill, showing flanged edges.

To use as an oven (FIG. 1), insert unit supports (12) into slits provided in each comer of base (1). Pull handles (11) located on the two end panels (3) and on the cover (5) from storage position into the out position as shown in (FIG. 1) which is the same instructions for grill and stove top assembly. Place end panel (3) in vertical position at one end of base (1) and select a seven inch (7) panel. Starting from the top of the flanged edge of end panel (3), slide the flanged edge of panel (7) downward into the groove provided, interlocking the two sections to form one comer. Select remaining seven inch (7) panel, and repeat previous procedure on the opposite side of end panel, forming the second comer. Attach remaining end panel (3) opposite the first end panel by sliding the flanged edge downward into the flanged edges of the two seven inch (7) panels. For additional cooking height, and to lower the amount of heat that reaches the food, add the two, two inch (2) panels on top of the two standing seven inch (7) panels, sliding panels downward into the flanged edges of end panels (3), or vice-versa, the two, two inch (2) panels can be connected to the two end panels (3) first and then the two seven inch (7) panels can stack on top of the two, two inch (2) panels. During this stage of assembly, the grill (8) is added by selectively inserting the grill (8) between the front and rear panels and placing horizontally across the interior of the frame, so that the flanged edges of the grill (8) sits on the top straight edge of the two, two inch (2) panels or the two, seven inch (7) panels, depending on which panel heights were chosen first, during assembly. If a solid cooking surface is desired for baking, such as biscuits, place one or two of the metal containers (FIG. 4, 6A and/or 6B), directly on top of the grill for support. Other combinations of front and rear panels (2), (4), (7), can be used to provide additional cooking heights. To enclose the unit for baking, as shown in (FIG. 1), add the two, four inch (4) panels' flanged edges into the end panels' (3) flanged edges, sliding panels downward so the edges meet the grill (8) that has already been inserted into the frame. Place cover (5) on top of the entire unit. The frame being of sturdy construction at this point can easily be lifted from the base (1) to add fuel. If charcoal is the choice of fuel, after igniting, allow flames to subside before placing frame back on base (1) to cook. To add additional fuel while baking, lift the frame from base (1) using the end handles (11) provided and protective gloves, set aside, add fuel and replace the frame.

Figure 2:
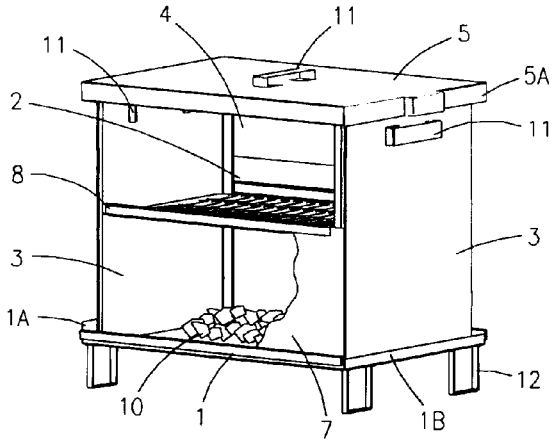
FIG. 2. View of grill assembly using charcoal fuel, with grill inserted, and cover added in case of adverse weather conditions.

To use as a grill, (FIG. 2) place end panel (3) in vertical position at one end of base (1) and select a seven inch (7) panel. Starting from the top of the flanged edge of end panel (3), slide the flanged edge of panel (7) downward into the groove provided, interlocking the two sections to form one corner. Select remaining seven inch (7) panel, and repeat previous procedure on the opposite side forming the second corner. Attach remaining end panel (3) opposite the first end panel by sliding the flanged edge of end panel (3) downward into the flanged edges of the two, seven inch (7) panels. During this stage of assembly, the grill (8) is added by selectively inserting the grill (8) between the front and rear panels and placing horizontally across the interior of the frame, so that the flanged edges of the grill (8) sits on the top straight edge of the two seven inch (7) panels. Different levels of grilling heights can be achieved by adding different combinations of front and rear panels (2), (7), (4). For seven inch cooking level, add only seven inch (7) panels, for six inch level cooking, combine two inch (2) and four inch (4) panels, and for nine inch cooking level, combine two inch (2) and seven inch (7) panels. Continue adding panels to one side only creating a rear wall, which in this example, would be one of the remaining four inch (4) panels and one of the two inch (2) panels. Connect the flanged edges of the four inch (4) and two inch (2) panels so that panels slide downward, interlocking into the flanged edges of the two end panels (3), to meet the existing grill (8). The frame being sturdy at this stage of assembly can be lifted from the base (1) and set aside to add fuel. If charcoal is the fuel of choice, after igniting charcoal, allow flames to subside before placing frame on base (1) to cook. When unit is in use and additional fuel is desired, using the end handles (11) and protective gloves, lift frame from base and set aside, add fuel, and then replace frame. The cover (5) can be added in case of adverse weather conditions.

Figure 3:
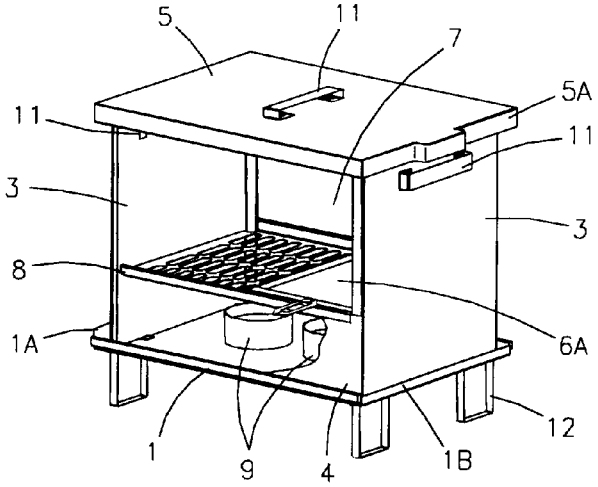
FIG. 3. View of stove top assembly using direct heat source such as Sterno canned heat, with grill inserted at a low cooking level, showing one of the two metal containers used when a solid cooking surface is desired, and cover added in case of adverse weather conditions.

To stove top cook (FIG. 3), refer to the same interlocking panel instructions as used in the grill and oven assembly (FIGS. 1 & 2), except use the two, four inch (4) panels on the bottom for front and rear assembly. Then place the grill (8) horizontally across the interior of the frame so that it sits on the top edge of the four inch (4) panels. Continue building the rear wall only of the stove by stacking the seven inch (7) and two inch (2) panels on top of the four inch (4) panel and grill, leaving the front open above the grill for cooking. Using four inch (4) panels allows the grill (8) to sit low to the flame creating faster cooking times. Other panels may be chosen to increase the cooking height if your choice of direct heat requires more space between the flame and the cooking surface than does the Sterno canned heat (9) example in (FIG. 3). If a half solid cooking surface is desired, for example, to use the grill side for heating water and the metal container for scrambling eggs or cooking pancakes, after placing grill (8) across interior of frame as mentioned above, place one metal container (6A or 6B) directly on top of grill (8) and to one side. Move handle (6C) located on top of metal container to the front. Once frame is assembled, remove frame from base (1) using the end handles provided (11), user may then add a direct heat source such as Sterno canned heat (9), ignite, and place unit back on base (1) for cooking.

Figure 6:
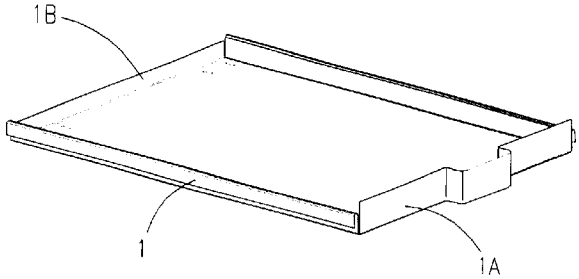
FIG. 6. View of flanged base, which holds the heat source such as charcoal or Sterno canned heat, but not limited to the aforementioned heat sources. Views show the two different heights of each end of the base. One end being almost twice the height of the opposite end. Slits for the support attachments also shown. Finger pull created by a metal indentation can be seen on one end of base for easy opening while in storage case configuration.
Figure 7:
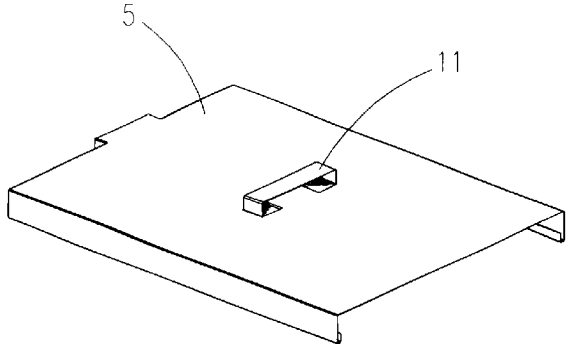
FIG. 7. View of cover, open on one end showing the U-shape flanged edge configuration used to connect base to top. Finger pull created by a metal indentation can be seen on one end of base for easy opening while in storage case configuration.
Figure 8:
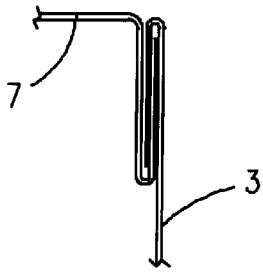
FIG. 8. View of units corner frame assembly connecting end panel to seven inch panel.
Figure 9:
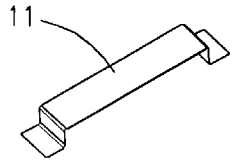
FIG. 9. View of the handle that inserts into the cover and the two end panels.
Figure 10:
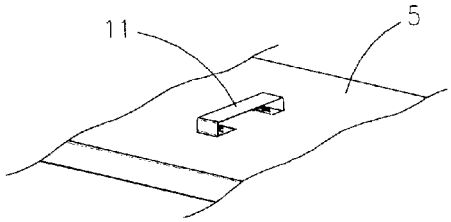
FIG. 10. View of handle showing indentation for easier attachment and in use position.
Figure 11:
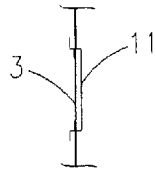
FIG. 11. Side view of handle as it is pressed against and through the outer panel wall toward the interior side of panel for storage.
Figure 12:
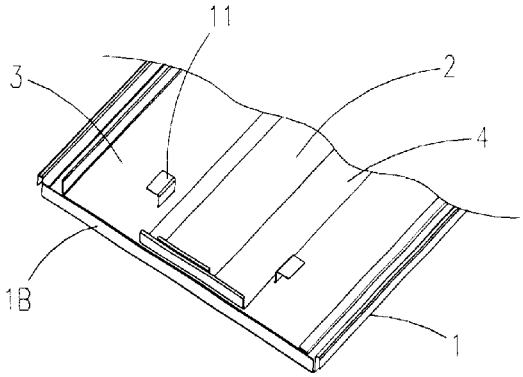
FIG. 12. View of handle from interior side of end panels (3) protruding upward with the 4 inch and 2 inch panels placed between handles for storage.
Figure 13:
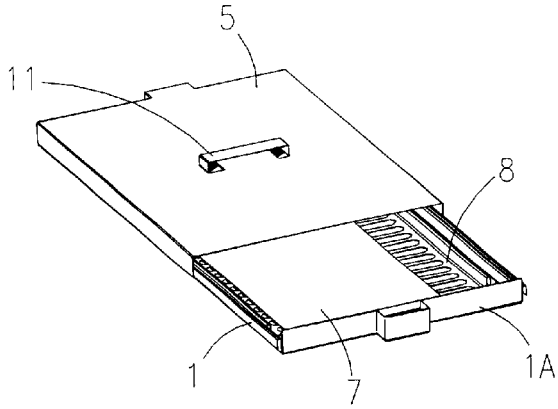
FIG. 13. View demonstrating the joining of the base's flanged edge or runner section, to the flanged edge or runner section of the cover, which stores the units members and forms the storage or carrying case.
Figure 14:
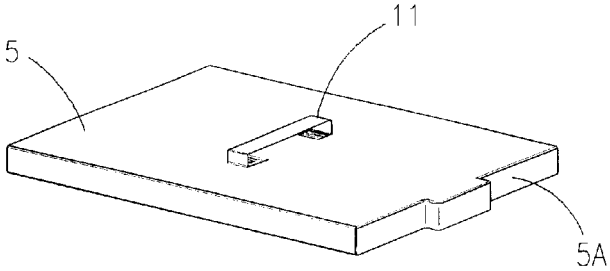
FIG. 14. View of unit when members are stored inside base and cover to form a carrying case which is easily transported or stored.
Figure 15:
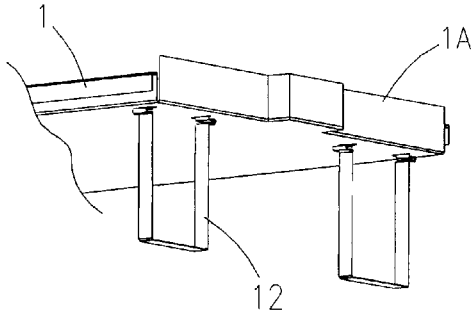
FIG. 15. View of flanged supports attached to base.

To disassemble and store unit, separate all panels. Locating the handles (11) that are found on the exterior of end panels (3) and cover (5), press handles flat against the exterior side of the panels (FIG. 11). This causes handle ends to protrude on the interior side of panels. To utilize all storage space, place one end panel (3) flat with protruding handle end up into the base (1) first, then proceed to place the two, two inch (2) panels and the two, four inch (4) panels between the protruding handle ends (FIG. 12). Continue adding remaining front, rear and end panels, grill (8) and metal containers (FIG. 6) with handles (6C) resting in a wing storage position, into the unit's base (1). Take the unit's cover (5) and connect the cover's flanged edge to the base's (1) flanged edge. Starting at the base's end that is lowest in height (FIG. 6, 1B) slide cover (5), open end first, through the flanged runner provided on the base to the opposite end. This allows the base's higher end (FIG.6, 1A) and the cover's open end (FIG. 7) to flush, enclosing all pieces of unit. This creates a compact case (FIG. 14) for carrying, storing or placing into a backpack for easy transporting.

I claim:

1. A collapsible, self-contained compact combination camp oven, stove top, and grill being of metal construction comprising: a frame having a plurality of front, rear and end panels of predetermined heights and sizes, a grill attached to said frame and said grill having flanges, a flanged base, wherein said front, rear and end panels have flanged edges, in which one side of said front, rear and end panels are projecting upward which forms a L shape configuration and the same projecting inward to the opposite edge and downward which forms a flat U shape configuration, wherein said opposite edge of said front, rear and end panels are projecting upward which forms a L shape configuration and the same outward then downward that forms a U shape configuration, wherein said flanged edges of the front and rear panels align vertically opposite each other, adjacent to and perpendicular to the end panels in which said flanged edges of said front and rear panels engage to said flanged edges of said end panels, and means for said front, rear and end panels to independently support and form said frame, wherein said front and rear panels having equal pairs of the same said predetermined heights and sizes and means for selectively stacking and interlocking said equal pairs to said flanged edges of said end panels and means for inserting said grill between said front and rear panels and across interior of said frame, wherein said grill with flanged edges rest on top of upper straight edge of said front and rear panels to achieve the desired cooking height for said oven, stove top or grill.

2. The grill of claim 1 wherein two edges are flanged, projecting upward 90 degrees which forms a L shape configuration and the same projecting outward then downward which forms a U shape configuration and means for said grill to insert between said front and rear panels and across interior of said frame so that the flanged edges of said grill rest on upper straight edge of said front and rear panels to achieve desired cooking height for said oven, stove top or grill.

3. The flanged base of claim 1 wherein said flanged base has means to attach a plurality of supports to said flanged base and said supports are constructed of continuous metal material equal in height, wherein ends of said supports are flanged.

* * * * *